US011064811B2

(12) United States Patent
Guy et al.

(10) Patent No.: US 11,064,811 B2
(45) Date of Patent: Jul. 20, 2021

(54) FITTED-SHEET RETENTION ARRANGEMENT

(71) Applicant: Beddingo Ltd., Kiryat Ono (IL)

(72) Inventors: Yonatan Guy, Kiryat Ono (IL); Irit Guy, Kiryat Ono (IL); Roni Guy, Kiryat Ono (IL)

(73) Assignee: Beddingo Ltd., Kiryat Ono (IL)

( * ) Notice: Subject to any disclaimer, the term of this patent is extended or adjusted under 35 U.S.C. 154(b) by 171 days.

(21) Appl. No.: 16/035,644

(22) Filed: Jul. 15, 2018

(65) Prior Publication Data

US 2020/0015597 A1 Jan. 16, 2020

(51) Int. Cl.
*A47C 21/02* (2006.01)

(52) U.S. Cl.
CPC ..... *A47C 21/022* (2013.01)

(58) Field of Classification Search
CPC ... A47C 21/022; A47G 9/0238; A47G 9/0246
See application file for complete search history.

(56) References Cited

U.S. PATENT DOCUMENTS 4,723,331 A * 2/1988 Weiss ..... A47G 9/0246 5/497
5,177,821 A * 1/1993 Kawtoski ..... A47G 9/0246 5/482
5,327,595 A * 7/1994 Allen ..... A47C 21/022 24/72.5
5,513,403 A * 5/1996 Wooten, Jr. ..... A47G 9/0246 112/418
6,739,002 B1 * 5/2004 Pannu ..... A47C 21/022 5/494
7,827,633 B2 * 11/2010 Taylor ..... A47C 21/022 5/488
9,545,164 B2 * 1/2017 Tulloch ..... A47G 9/0246
10,368,654 B2 * 8/2019 Sopher ..... A47C 21/028
2008/0215028 A1 * 9/2008 Brown ..... A61F 13/505 604/385.15

FOREIGN PATENT DOCUMENTS

EP 0158132 A1 * 10/1985 ..... A47C 21/022

* cited by examiner

*Primary Examiner* — Eric J Kurilla
*Assistant Examiner* — James T Coble
(74) *Attorney, Agent, or Firm* — Mark M. Friedman

(57) ABSTRACT

The present invention provides a bedding system where a band is placed along the periphery of a mattress, the band including regions of one of a hook or loop type fastener. A sheet with the corresponding hook or loop fastener covers the mattress, and the corresponding fastener on the sheet contacts the band at the region, such that the sheet attaches to the band.

7 Claims, 7 Drawing Sheets

FITTED-SHEET RETENTION ARRANGEMENT

TECHNICAL FIELD

The present invention is directed to bedding.

BACKGROUND OF THE INVENTION

Conventional bed sheets usually have a rectangular shape and are fastened to a mattress by repeatedly lifting the mattress and tucking the bed sheet edges under the mattress, between the mattress and the bed base. Today's mattresses are becoming much larger and heavier, making repetitive lifting difficult even to strong and healthy individuals. Tucking the bed sheet edges under the mattress exposes the conventional bed sheets to the possibility of being pulled out from beneath the mattress during their use and may cause a repeated need to remake the bed. People who tend to be restless sleepers are more prone to the possibility of untucking the bed sheet.

Fitted sheets with elastic elements integrated to their corners have been used as a solution to fasten the fitted sheet to the mattress. However, these elastic elements are still do not always prevent the pulling out of the sheet's skirts from beneath the mattress. Such fitted sheets are also awkward to deploy, with each corner tending to become dislodged as the sheet is stretched out to fit the next corner.

SUMMARY OF THE INVENTION

The present invention provides a bed set for use with a mattress.

Thus, according to an embodiment of the present invention there is provided a bed set for use with a mattress having a top surface and a periphery including four peripheral edges and four corners, the bed set comprising:

a band configured to extend around the periphery of the mattress, the band including anchoring regions located on the band so as to align with the corners of the mattress, each of the anchoring regions providing a first part of a hook-and-loop fastener;

at least one sheet configured for placement on the mattress, the at least one sheet comprising a central region for covering the top surface of the mattress and a fitted skirt having four corner portions and shaped for fitting closely around the periphery of the mattress, the sheet being provided with fastening regions associated with the four corner portions, each of the fastening regions having a complementary part of a hook-and-loop fastener for fastening to said anchoring regions According to further features of an embodiment of the present invention, the first part of a hook-and-loop fastener in the anchoring regions is a loop fastener and the complementary part of a hook-and-loop fastener is a hook fastener, the sheet being further provided with supplementary regions of a loop fastener located so as to allow closure against the hook fastener when the sheet is removed from the mattress.

According to further features of an embodiment of the present invention, the first part of a hook-and-loop fastener in the anchoring regions is a hook fastener and the complementary part of a hook-and-loop fastener is a loop fastener.

According to further features of an embodiment of the present invention, at least one corner of the at least one sheet includes an integrated tensioning element fixed to the sheet for enhancing a fit of the sheet on the mattress.

According to further features of an embodiment of the present invention, the band includes a pair of strips at each of the corners configured for traversing corners of the mattress diagonally so as to maintain a position of the band on the mattress.

According to further features of an embodiment of the present invention, outer edges of the at least one sheet are formed with a convex curvature.

BRIEF DESCRIPTION OF THE DRAWINGS

Some embodiments of the present invention are herein described, by way of example only, with reference to the accompanying drawings. With specific reference to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

Attention is now directed to the drawings, where like reference numerals or characters indicate corresponding or like components. In the drawings.

DETAILED DESCRIPTION OF THE DRAWINGS

The present invention is not limited in its application to the details of construction and the arrangement of the components set forth in the following description. The invention is capable of other embodiments, or of being practiced or carried out in various ways. Also, it is to be understood that the phraseology and terminology employed herein is for the purpose of description and should not be regarded as limiting.

The present invention provides a bedding system that includes a band configured to extend around the periphery of a mattress, and a fitted sheet configured for placement on the mattress. The band and the fitted sheet are connected using hook-and-loop fasteners.

Figure 1A:
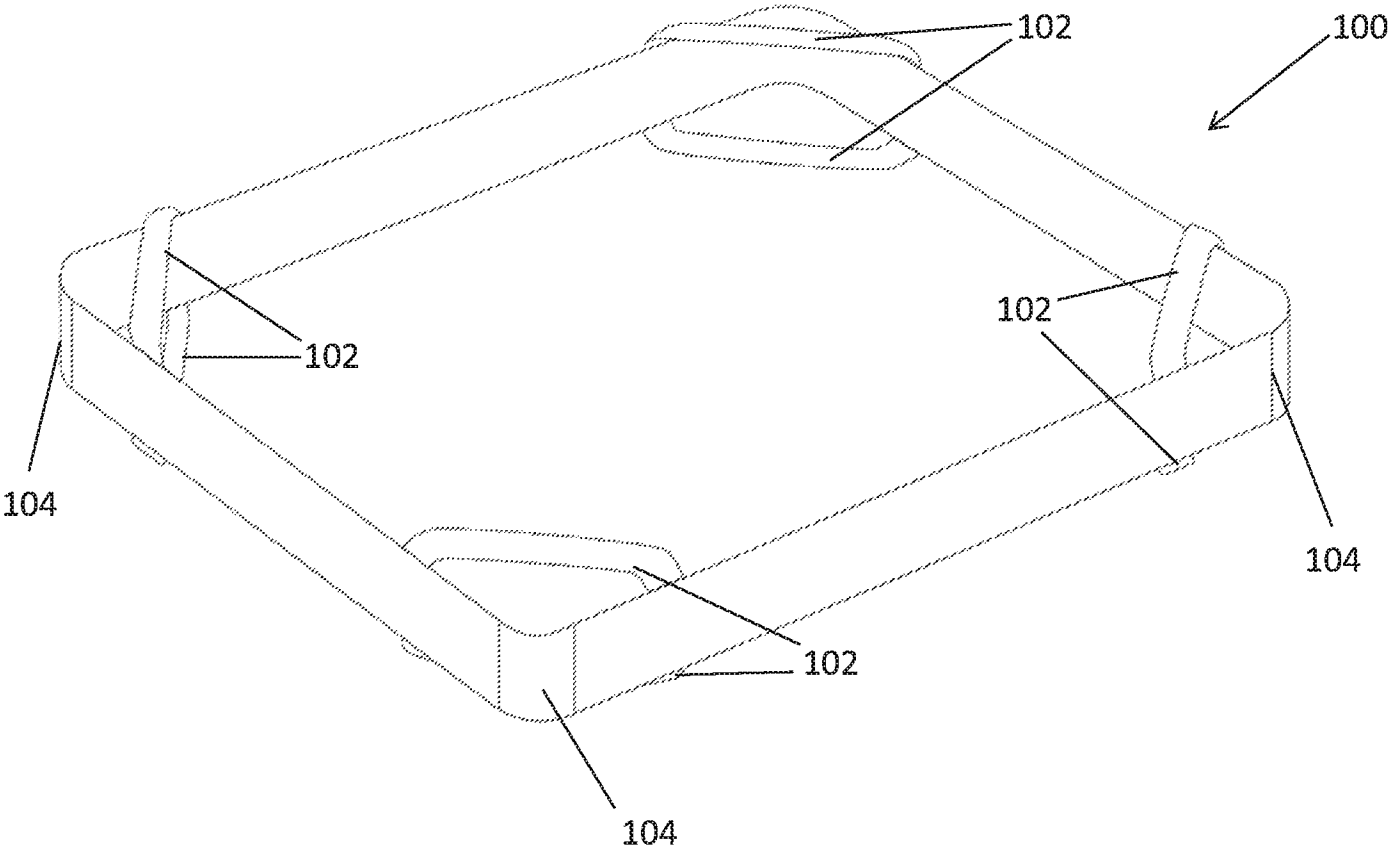
FIG. 1*a* is a schematic isometric view of a band from a bed set, constructed and operative according to an embodiment of the present invention.

FIG. 1*a* is an illustration of the band 100. The band 100 is preferably a broad band, typically with somewhat elastic properties, for deployment around the periphery of a mattress. The entire band may be formed from material having somewhat elastic properties, or specific regions located at one or more areas of the band may be elastic, thereby facilitating snug fitting of the band around a mattress, and possibly accommodating some variation in sizes between mattresses. The width of the band is typically in the range of 10-20 cm, so as to sit stably against the edge of the mattress and in some particularly preferred cases to span a majority of the edge thickness of the mattress. In some cases, at least part of the length of the band can have a width of less than 10 cm. Furthermore, the width may in some cases vary along the length of the band, for example, with broader regions of above 10 cm providing stability in the corner anchoring regions, and narrower portions, for example of width less than 10 cm, extending along the length of some or all of the sides of the mattress.

In the particularly preferred but non-limiting implementation illustrated here, band 100 includes pair of strips 102 located on each corner of band 100, which are configured for traversing the corners of the mattress diagonally, one above the mattress and one below, creating a symmetric band wrapping the mattress, in order to maintain the position of the band roughly centered in the thickness dimension of the mattress around the periphery of the mattress. The distance between each pair of strips 102 and the corresponding corner of band 100 affects the length of the strips, with the length of the strips being chosen to effectively anchor the band around the corner of the mattress. The exact length of the straps may vary according to the relative elasticity of the materials used and the range of mattress thicknesses to be accommodated, and will readily be determined by a person having ordinary skill in the art. The spacing of the attachment points of strips 102 from the corners is preferably at least about 15 cm, and most preferably between about 20 cm and about 40 cm, in order to ensure secure fastening to the corners of a mattress.

The placement of band 100 around the periphery of the mattress is a one-time task after which there is no need for repetition or handling, meaning that the band typically remains installed on the mattress indefinitely. Due to its symmetry, the band enables turning and/or flipping the mattress in any direction without requiring adjustment of the band deployment and without impacting the functionality of the band. The band 100 further includes anchoring regions 104 located at its corners so as to align with the corners of a mattress. Each of the anchoring regions 104 includes a first part of a hook-and-loop fastener, which can be either a hook fastener or a loop fastener according to two different embodiments of the invention, detailed further below.

In one embodiment, the hook-and-loop fastener of band 100 is a loop fastener covering the entire height of anchoring region 104.

Figure 1B:
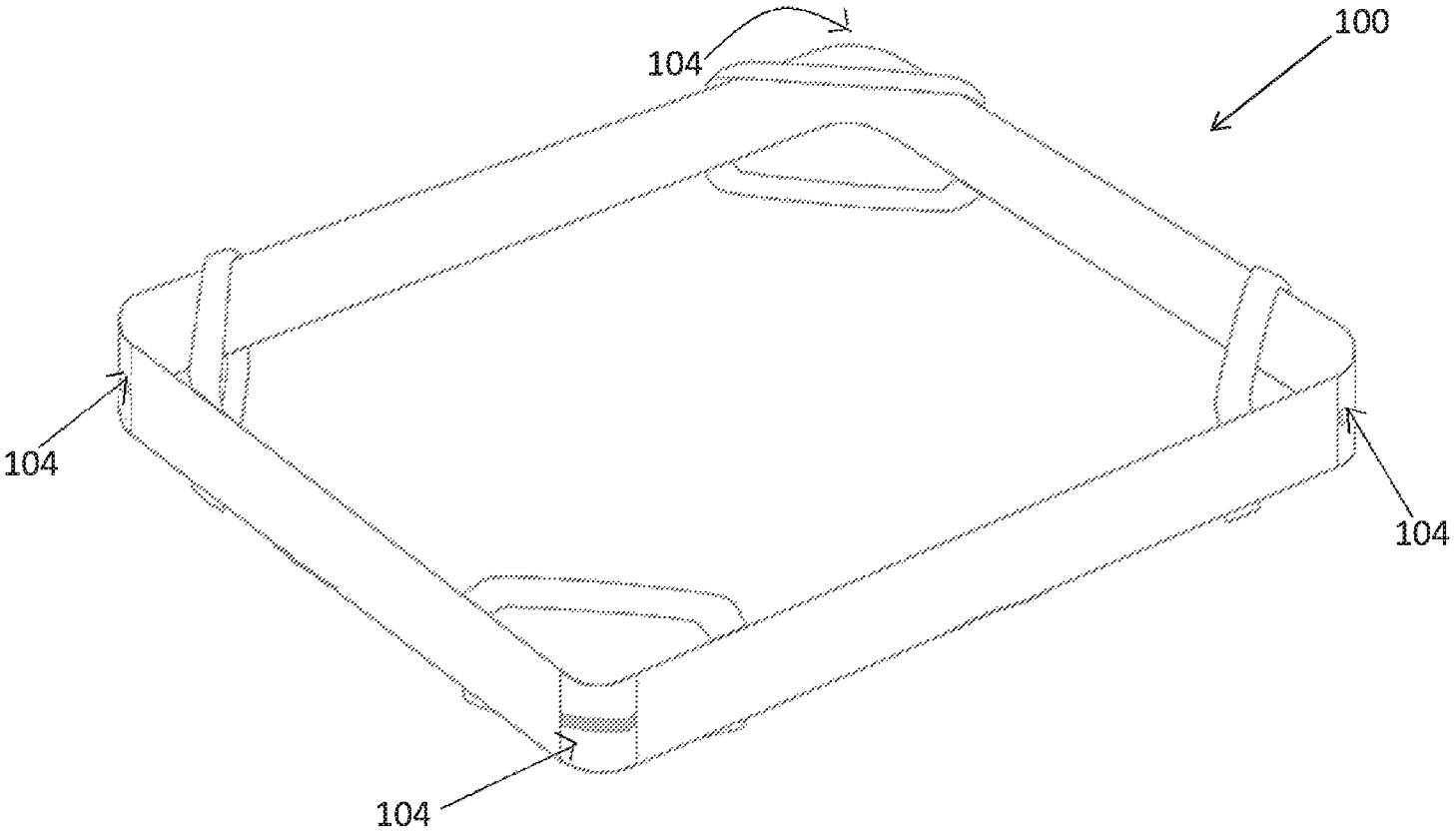
FIG. 1*b* is a schematic isometric view according to an embodiment of the bed set of the present invention showing a hook fastener in the form of a horizontal strip located at the middle of the height of an anchoring region of a band.

In another embodiment, best seen in FIG. 1*b*, the hook-and-loop fastener of band 100 is a hook fastener in the form of a horizontal strip, typically located at the middle of the height of anchoring regions 104.

The band 100 and the pair of strips 102 are preferably implemented in a number of different sizes, each suited to a corresponding size, or range of sizes, of mattress.

In one embodiment, the band length is matched to a mattress of length 120 cm and width is 84 cm. In another embodiment, the band length is matched to a mattress of length 120 cm and width is 96 cm. In yet another embodiment, the band length is matched to a mattress of length 120 cm and width is 108 cm. In each of these examples, the width of the band (deployed against the height of the mattress edges, which correspond to the thickness of the mattress) is typically about 15 cm, and the thickness of the strips 102 is typically about 6 cm.

Figure 2:
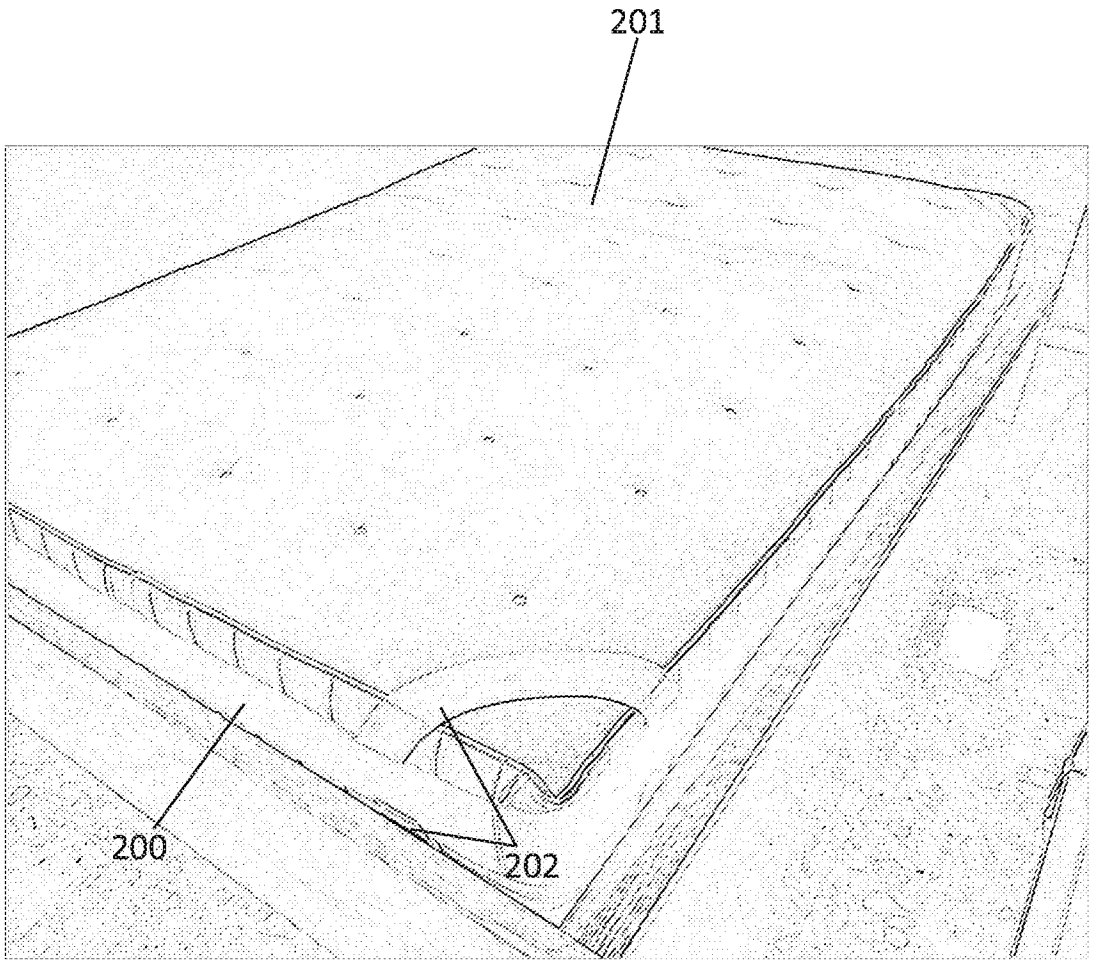
FIG. 2 is an isometric view of the band of FIG. 1 deployed so as to extend around the periphery of a mattress.

FIG. 2 is an illustration of the band 200 extending around the periphery of a mattress 201. The band 200 is maintained in position around the periphery of the mattress 201 using the pair of strips 202.

Figure 3:
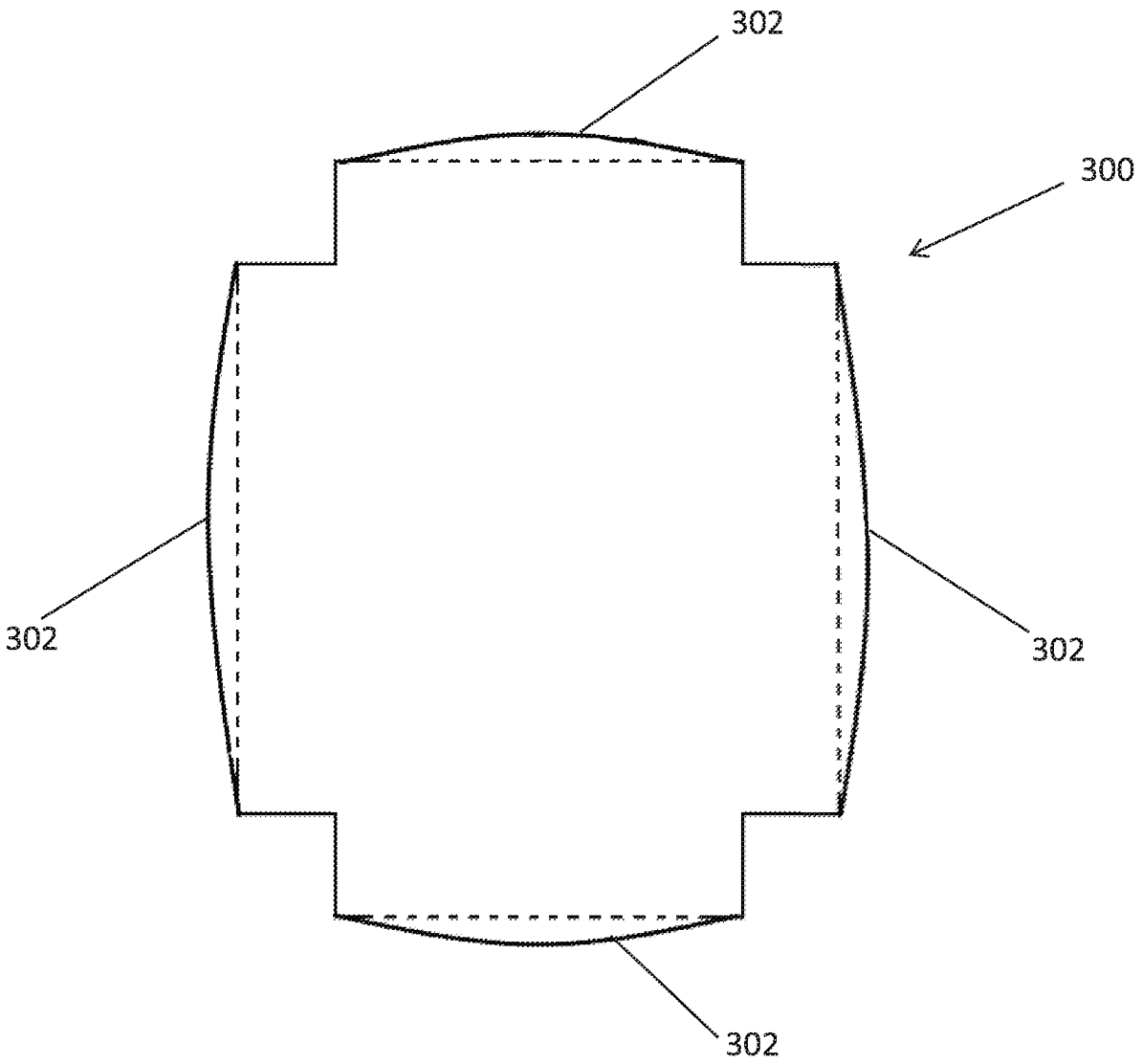
FIG. 3 is a plan view of a blank of material used to form a fitted sheet according to an embodiment of the bed set of the present invention.
Figure 4:
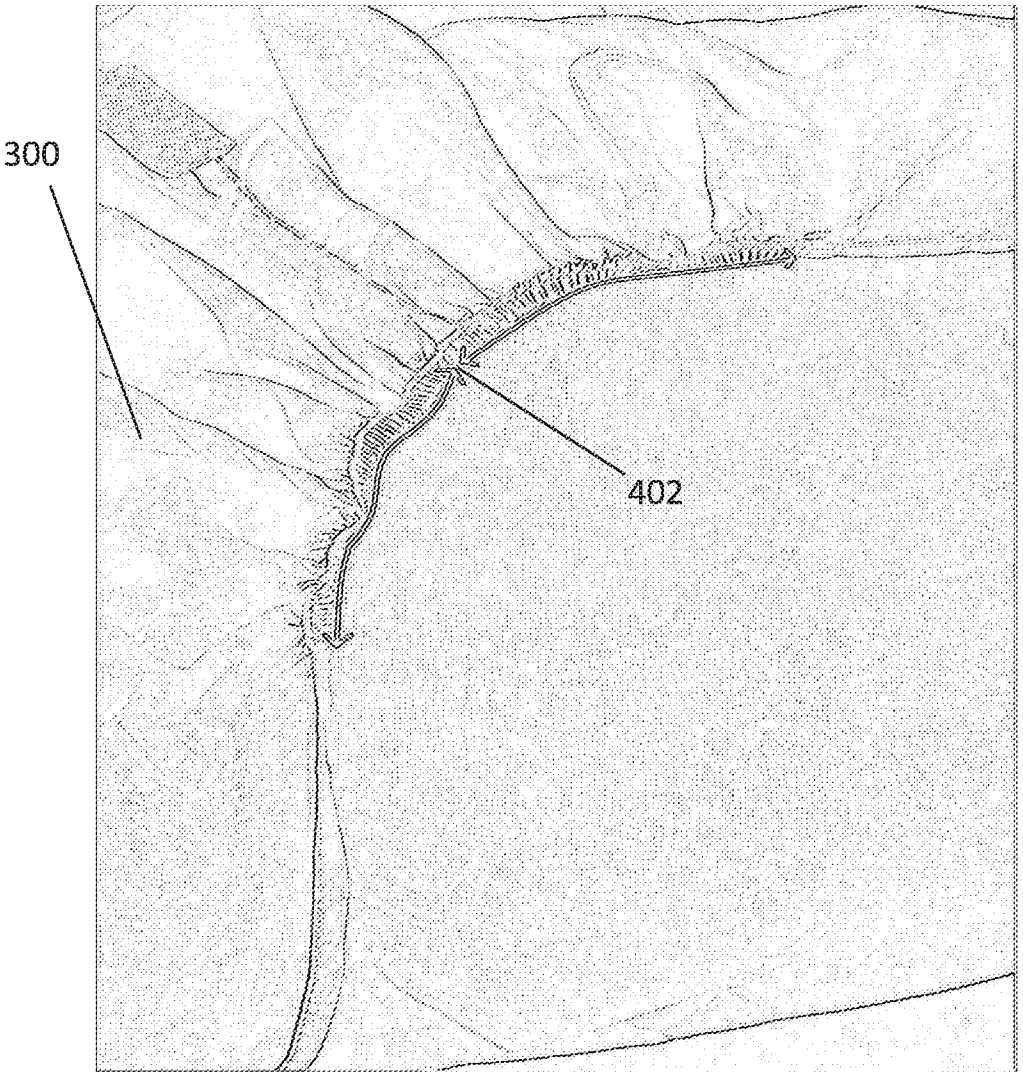
FIG. 4 is a partial plan view of a fitted sheet according to an embodiment of the bed set of the present invention showing an integrated tensioning element fixed to the corner of the sheet.

FIG. 3 is an illustration of a blank of material for the fitted sheet 300 configured for placement on a mattress. The sheet 300 includes a central region for covering the top surface of a mattress and a fitted skirt having four corner portions. The fitted skirt, once sewn together along the corner seams, is shaped for fitting closely around the periphery of the mattress, but preferably without tucking beneath the mattress. The outer edges 302 of sheet 300 in this particularly preferred implementation are formed with a convex curvature in order to compensate for the shortfall that often occurs as a sheet is stretches across a mattress, typically leading to an unsightly revealed portion of the mattress near the middle of each side. The extent of the "bulge" of the convex profile beyond the straight edge (dashed line) is typically between about 3 cm and about 6 cm near the middle of each side, and preferably results in what appears to be a roughly straight edge when deployed on a mattress. The corners of sheet 300 preferably include a fixed integrated tensioning element 402, best seen in FIG. 4, which is used for enhancing the fit of sheet 300 on the mattress. The sheet 300 further includes fastening regions associated with the four corner portions that contain complementary parts of hook-and-loop fasteners for fastening them to the band anchoring regions. The complementary parts of hook-and-loop fasteners can be connected to sheet 300 directly or indirectly via a connecting layer that helps to prevent the occurrence of stretch marks around the periphery of the complementary parts of hook-and-loop fasteners.

Figure 5:
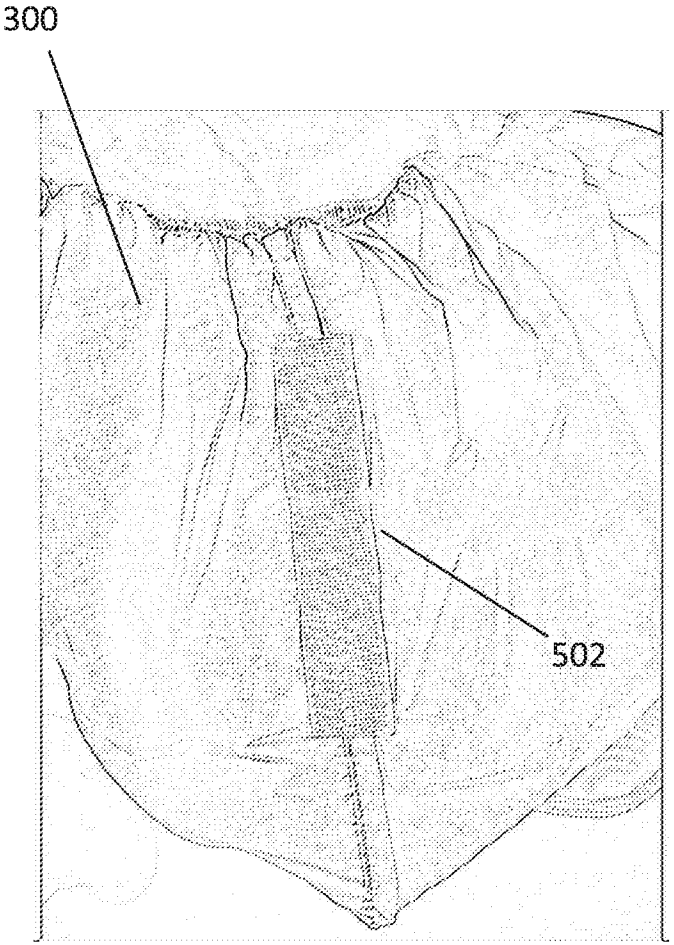
FIG. 5 is a partial plan view of a fitted sheet according to an embodiment of the bed set of the present invention showing deployment of a loop fastener is located at a corner of the fitted sheet.

FIG. 5 is an illustration of one embodiment of the present invention in which the fitted sheet 300 contains a loop fastener 502 designed to correspond with a hook fastener located on the corresponding corner anchoring region 104 of band 200. FIG. 5 illustrates one corner of the fitted sheet 300 in an enlarged view, but it will be appreciated that all four corners of sheet 300 are typically implemented identically. In FIG. 5 the loop fastener 502 is stitched vertically on top of the inner stitch of one corner of the fitted sheet 300, i.e., so as to extend vertically in its deployed position, and can be fastened to a horizontally-extending strip of hook fastener located on an anchoring region of a band. Use of a horizontally-extending strip of hook fastener together with a vertically-extending strip of loop fastener is advantageous as it allows reliable engagement of the sheet to the base while being insensitive to minor misalignments. The retaining force of the fastener has been found effective even with a relatively small region of overlap. Furthermore, the relatively small horizontally-extending strip of hook fastener has been found to avoid damage to conventional bed sheets deployed on the mattress. The use of loop fastener as the part of a hook-and-loop fastener located on the corner of multi-use fitted sheet may be advantageous for the protection of other clothing and bedding during laundry, since the loop fastener is softer than the hook fastener, and as a result, is less likely to damage other clothing and bedding.

Figure 6:
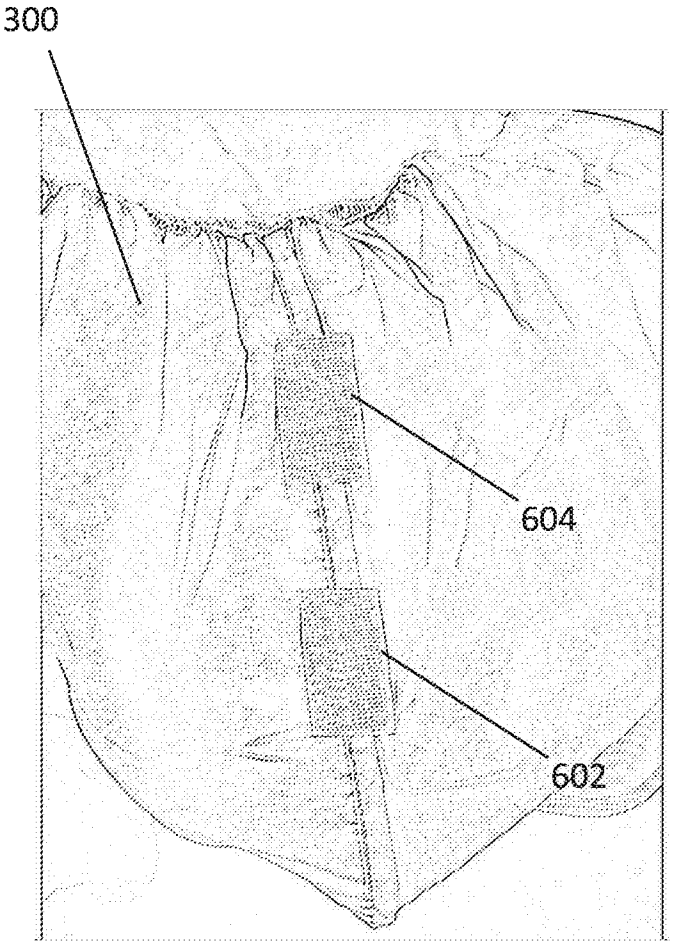
FIG. 6 is a partial plan view of a fitted sheet according to a variant implementation of the bed set of the present invention showing deployment of a loop fastener and a complementary hook fastener at the same corner of the fitted sheet.

FIG. 6 is an illustration of another embodiment of the current invention in which the fitted sheet 300 contains a hook fastener 602 and a complementary loop fastener 604 on the same corner. The hook fastener 602 is designed to engage a loop fastener located on the corresponding corner anchoring region 104 of band 200. The use of a loop fastener on band 200 may be advantageous since it avoids the mattress presenting a high-friction surface to anything happening to rub against the mattress when no sheet is in place. In FIG. 6 the hook fastener 602 and the complementary loop fastener 604 are stitched on top of the inner stitch of one corner of the fitted sheet 600. The loop fastener 604 is preferably closed against the hook fastener 602 when the sheet 300 is removed from a mattress. This prevents hook fastener 602 from damaging other clothing and bedding during laundering.

It has been found that the use of localized hook-and-loop fasteners in the corner regions between a fitted sheet and a mattress is highly effective to keep the sheet in position without requiring undertucking of the sheet beneath the mattress, and provides for neat deployment of the sheet without creep or dislodging during use. The fasteners have also been found to greatly facilitate and speed up correct deployment of the sheet, even allowing rapid deployment using only one hand (particularly important for people with physical disabilities). The provision of the fasteners on a band that can be deployed around a standard mattress allows use of the bed set on standard-production mattresses without modification.

While the invention has been described with respect to a limited number of embodiments, it will be appreciated that many variations, modifications and other applications of the invention may be made. Therefore, the claimed invention as recited in the claims that follow is not limited to the embodiments described herein.

The invention claimed is:

1. A bed set for use with a mattress having a top surface and a periphery including four peripheral edges and four corners, the bed set comprising:

a band configured to extend around the periphery of the mattress, the band including anchoring regions located on said band so as to align with the corners of the mattress, each of said anchoring regions providing a first part of a hook-and-loop fastener, said band being sized to extend around the periphery of the mattress without overlapping the top surface of the mattress; and at least one sheet configured for placement on said mattress, said at least one sheet comprising a central region for covering the top surface of the mattress and a fitted skirt having four corner portions and shaped for fitting closely around the periphery of the mattress, said sheet being provided with fastening regions associated with said four corner portions, each of said fastening regions having a complementary part of a hook-and-loop fastener for fastening to said anchoring regions, wherein the first part of the hook-and-loop fastener is a first strip having a length extending horizontally along the band, and wherein the complementary part of the hook-and-loop fastener is a second strip having a length extending vertically along the anchoring region.

2. The bed set of claim 1, wherein said first part of a hook-and-loop fastener in said anchoring regions is a loop fastener and said complementary part of a hook-and-loop fastener is a hook fastener, said sheet being further provided with supplementary regions of a loop fastener located so as to allow closure against said hook fastener when the sheet is removed from the mattress.

3. The bed set of claim 1, wherein said first part of a hook-and-loop fastener in said anchoring regions is a hook fastener and said complementary part of a hook-and-loop fastener is a loop fastener.

4. The bed set of claim 1, wherein at least one corner of said at least one sheet includes an integrated tensioning element fixed to said sheet for enhancing a fit of said sheet on the mattress.

5. The bed set of claim 1, wherein said band has a pair of positioning strips at each of said corners configured for traversing corners of the mattress diagonally so as to maintain a position of said band on the periphery of the mattress.

6. The bed set of claim 1, wherein an outer edge of said at least one sheet extending from a first of said corner portions to an adjacent one of said corner portions is formed with a convex curvature.

7. The bed set of claim 1, wherein said band has a maximum width no greater than 20 centimeters for placement around the periphery of the mattress without overlapping the top surface of the mattress.

* * * * *